US006526662B1

(12) United States Patent
Adachi

(10) Patent No.: US 6,526,662 B1
(45) Date of Patent: Mar. 4, 2003

(54) SCISSORS WITH MINUTE RECESSED PARTS FORMED AT BLADE TIP AND METHOD OF MANUFACTURING THE SCISSORS

(75) Inventor: Hidemi Adachi, Seki (JP)

(73) Assignee: Adachi Kogyo, Inc., Seki (JP)

( * ) Notice: Subject to any disclaimer, the term of this patent is extended or adjusted under 35 U.S.C. 154(b) by 0 days.

(21) Appl. No.: 09/857,394

(22) PCT Filed: Aug. 17, 2000

(86) PCT No.: PCT/JP00/05530

§ 371 (c)(1),
(2), (4) Date: Jun. 5, 2001

(87) PCT Pub. No.: WO01/62451

PCT Pub. Date: Aug. 30, 2001

(30) Foreign Application Priority Data

Feb. 24, 2000 (JP) ..... 2000-047655

(51) Int. Cl.[7] ..... B26B 13/00; B26B 19/00; B21K 11/00

(52) U.S. Cl. ..... 30/233; 30/225; 76/104.1

(58) Field of Search ..... 30/225, 131, 233, 30/194; 76/82.2, DIG. 8, 104.1

(56) References Cited

U.S. PATENT DOCUMENTS

| | | | | | |
|---|---|---|---|---|---|
| 21,369 | A | * | 8/1858 | Roome | 30/233 |
| 84,860 | A | * | 12/1868 | Craig | 30/131 |
| 297,964 | A | * | 5/1884 | Bateman | 30/233 |
| 434,145 | A | * | 8/1890 | Gamble | 30/131 |
| 517,969 | A | * | 4/1894 | Tolman, Jr. | 30/131 |
| 616,639 | A | * | 12/1898 | Shain | 30/233 |
| 1,294,998 | A | * | 2/1919 | Billy | 30/131 |
| 1,466,193 | A | * | 8/1923 | Schuster | 30/131 |
| 1,639,617 | A | * | 8/1927 | Seavey | 30/131 |
| 1,903,257 | A | * | 3/1933 | Dahl | 30/131 |
| 2,434,268 | A | * | 1/1948 | Hartkopf | 30/194 |
| 2,639,504 | A | * | 5/1953 | May | 30/233 |
| 2,688,186 | A | * | 9/1954 | Kraepelin | 30/233 |
| 3,222,783 | A | * | 12/1965 | Kolts et al. | 30/131 |
| 4,215,474 | A | * | 8/1980 | Kelley | 30/233 |
| 4,428,124 | A | * | 1/1984 | Asakura | 30/233 |
| 4,850,110 | A | * | 7/1989 | Meier, Jr. | 30/233 |
| 4,868,987 | A | * | 9/1989 | Irving | 30/233 |
| 5,107,591 | A | * | 4/1992 | Sato | 30/195 |
| 5,297,342 | A | * | 3/1994 | Malone | 30/131 |
| 5,421,090 | A | * | 6/1995 | Chiou | 30/254 |
| D429,982 | S | * | 8/2000 | Kamrath | D8/57 |
| 6,129,622 | A | * | 10/2000 | Seaman et al. | 30/233 |
| 6,141,877 | A | * | 11/2000 | Suetsugu | 30/233.5 |
| D452,125 | S | * | 12/2001 | Quessard | D8/57 |
| 6,385,851 | B2 | * | 5/2002 | Yeh | 30/195 |

FOREIGN PATENT DOCUMENTS

| | | | | |
|---|---|---|---|---|
| GB | 16293 | * | 5/1905 | 30/131 |
| GB | 26629 | * | 11/1907 | 30/131 |

* cited by examiner

*Primary Examiner*—Allan N. Shoap
*Assistant Examiner*—Jason Prone
(74) *Attorney, Agent, or Firm*—Perkins, Smith & Cohen LLP; Jerry Cohen

(57) ABSTRACT

A pair of haircut scissors having hair-catching slits on one of their haircut edges are disclosed. Each slit is provided with a filler having a renewable microscopic nick on its top edge to prevent hairs from sliding along the haircut edges. The filler prevents hairs from entering the slits, and as the nick is renewable, the hair-holding property of the pair of haircut scissors will be permanently retained.

13 Claims, 5 Drawing Sheets

SCISSORS WITH MINUTE RECESSED PARTS FORMED AT BLADE TIP AND METHOD OF MANUFACTURING THE SCISSORS

FIELD OF THE INVENTION

This invention generally relates to haircut scissors. More particularly, this invention relates to haircut scissors that prevent hairs from escaping along the haircut edges of the haircut scissors so as to achieve neat and efficient haircut.

BACKGROUND ART

It is known that hairs pinched between haircut edges 102 of a conventional pair of haircut scissors 101 escape or slip as indicated by an arrow in the accompanying FIG. 5, and often partially remain uncut. Hairs which are neatly combed tend to be cut along a curved line with a conventional pair of haircut scissors against intent as shown in the accompanying FIG. 6 due to slippage of the hairs along the haircut edges of the scissors.

Such slippage of hairs can take place with conventional thinning scissors or shears as well. In an attempt to prevent such slippage, a conventional pair of thinning scissors are provided with V-shaped or U-shaped haircut edges 202 between protrusions as shown in the accompanying FIG. 7. Hair slippage on the haircut edges 202 of the thinning scissors is thus effectively prevented.

The assignee of this application disclosed in International Application No. PCT/JP99/05381 slits 304 having a predetermined length and width as schematically shown in the accompanying FIGS. 8, 9 and 10 which are provided at intervals along a haircut edge L of a pair of haircut scissors. The width W of these slits 304 is smaller than twice that of a typical hair. These slits 304 provide the following advantageous features.

Even when the width W of the slits 304 is somewhat smaller than that of a typical hair, a hair X which is sliding on the haircut edge L in the direction indicated by an arrow will itself get caught on the mouth 305 of one of the slits 304 and obstruct movement of other hairs that follow as shown in the accompanying FIG. 8. Thus, slits 304 having a width W which is smaller than that of a typical hair will work as a hair slippage stop.

When the width W of the slits 304 is as large as that of a typical hair, a hair or hairs X traveling in the direction indicated by an arrow will somehow get into one of the slits 304 and obstruct movement of other hairs that follow as shown in the accompanying FIG. 9. Thus the slits 304 having a width W as large as that of a typical hair will work as a hair slippage stop.

When the width W of the slits 304 is nearly twice that of a typical hair, a plurality of hairs will enter slits 304 one after another or get caught together at the mouth 305 of slits 304 as shown in the accompanying FIG. 10. Thus the slits 304 which possess a width which is greater than that of a typical hair but smaller than twice that of a typical hair will also work as a hair slippage stop.

Slits 304 provided at intervals along a haircut edge L of a pair of haircut scissors, whose breadth W is made smaller than twice that of a typical hair, can effectively prevent hair slippage.

When cut, hairs whose breadth W is smaller than that of the slits 304 may get temporarily stuck within the slits 304, however, they will eventually and naturally fall out of the slits during use of the haircut scissors. Hairs whose width W is larger than that of the slits 304 may also be squeezed somehow into the slits 304 and remain within the slits. However, the stuck hairs can be raked out easily with fingers or readily brushed off.

Some people, however, particularly love cleanliness. Such people hate to see any cut hairs remain within the slits 304 even temporarily. Downy hairs will get caught within the slits 304 more easily than full fledged ones. Professional barbers as well as beauticians therefore cannot disregard as trifles such particularity of their customers.

In addition, thick hairs will be damaged if they are forcedly pressed into narrow slits 304 or scraped against the side edges of the slits 304. Such damage should be carefully avoided.

Accordingly, it is an object of the present invention to provide a pair of haircut scissors having such slits that can effectively eliminate hair slippage on a haircut edge or edges of the haircut scissors without damages to hairs.

It is another object of the present invention to provide a pair of haircut scissors having such slits that can prevent cut hairs from getting stuck within the slits.

SUMMARY OF THE INVENTION

According to an embodiment of the present invention, as defined in the attached claim 1, fine slits are arranged along a haircut edge of a pair of haircut scissors. Each slit is provided thinner than twice the thickness of a typical hair, and is filled up with a filler. One reason why the slit should be thinner than twice the thickness of a typical hair is that if the slit is more than twice as thick as a typical hair, the haircutting performance of a pair of scissors incorporating such slits will become poor. A top portion of each filler is chipped off to a degree to provide a microscopic nick so as to catch a hair or hairs therewith, effectively preventing hair slippage or escape on the haircut edge.

It is to be noted that the term "a pair of scissors" as used herein includes a pair of thinning scissors or shears and other scissors used to cut hair.

The filler will not hinder the expected function of the slit because the nick compensates that expected function. There are a number of ways to provide such a filler having a nick.

The nick of a filler may be provided concurrently with whetting processes of the haircut edge, as defined in the attached claim 2, since amicroscopic top portion of the filler is very thin and thus relatively or very fragile. The nick may be so small as to be virtually indiscernible to the naked eye.

The haircut edge of a scissors blade requires whetting once in a while in order to retain professional cutting property. Each whetting process will produce a fresh nick on the filler. Therefore, the filler will always have a nick at its top edge.

The filler may be provided so flexible as defined in the attached claim 3 as to be pressed and deformed by a hair or hairs to provide a nick. Such a flexible filler may be an elastically deformable material such as a rubber material, or a plastically deformable material such as a plastic material or a soft metallic material.

A plastically deformable filler will provide a permanently deformed nick when its top edge is pressed by a hair, while an elastically deformable filler will provide a temporarily deformed nick which will disappear when the pressure from a hair is removed. These fillers eliminate nick forming processes.

A filler of the present invention may be provided by plating means as defined in the attached claim 4. A metallic material when plated in the fine slit will fill up the void of the slit. The filler when formed in the slit by plating means will provide a natural notch in an indeterminate form at a top edge portion of the filler as will be readily appreciated by a person skilled in the art. The plated filler is stable and rigid.

The attached claim 5 defines use of metallic powder whose melting point is somewhat lower than the metallic material of a scissors blade where slits are formed. The powder is filled up in each slit and immersion plated with the same or different metallic material whose melting point is the same or only slightly different from the powder material to form a filler in the slit. The metallic powder may be Au, In or Sn, and the immersion plating material may also be Au, In or Sn, or other materials whose melting points are respectively close to those of the powder materials.

A method for providing a pair of haircut scissors which include a scissors blade having a plurality of slits each with a filler which is formed by plating is defined in the attached claim 6.

The filler may be provided by electroplating as defined in the attached claim 7. Electroplating will fill up the void of each slit with a plating material. An adequately formed filler may be provided in the slit by repeating the plating process, if a single process has proved to be inadequate. The scissors blade may be masked except in the slits to provide improved and stable plating of fillers in the slits.

Such plating may be provided with an Au material for example, and the masking may be provided with a resist plating ink, masking paint, chromium oxide plating material or enamel paint. Other plating and masking materials may equally be utilized.

Such plating may be provided by immersion plating with a metallic material having a lower melting point than the metallic material of the scissors blade as defined in the attached claim 8. Immersion plating may be advantageously utilized for "thick" slits where electroplating alone may be insufficient.

The attached claim 9 defines plating in the slits on a ferrous scissors blade. Although scissors materials are generally ferrous materials such as stainless steel materials, nonferrous materials as well as hard metals or alloys may be used as well. Therefore, the method for plating as well as the plating material should be appropriately selected taking the scissors blade material used into consideration.

A scissors blade made of a ferrous material is subjected to slit-filler processes. The ferrous scissors blade, after or before its final forming processes, is masked with a plating resist and then provided with numerous slits on the haircut edge of the scissors blade. The masking material may be a nonconductive resin, chromium oxide or Sn/Ni material. Other appropriate masking materials may also be adequately utilized.

The slits are exposed without a masking resist film. The slits are then activated, e.g. by anodic electrolysis in phosphoric acid, and immersion plating in hydrochloric acid or phosphoric acid. The activated slits are electroplated in a plating bath, and a bonding film is formed on the slit walls. The plating bath material for electroplating may be Ni, Au, Cu, Fe, Sn/Pb, Sn/Ag or Sn/Bi. Other plating materials may also be equally utilized.

The slits having a bonding film on the inner surfaces thereof for improved wettability are further immersion plated with a plating material having a lower melting point than the material of the scissors blade so as to provide fillers of the present invention in the slits. The plating material having a lower melting point than the scissors blade may be Sn/Ag alloys, Sn/Ag/Cu alloys, Au materials, In solder materials or In alloys. A chief reason the immersion plating material should have a lower melting point than the material of the scissors blade is to avoid tempering of the scissors blade. If not, the haircut edge will get dull.

An alternative method is provided as defined in the attached claim 10, where slits are prepared on the haircut edge of a scissors blade before its masking process unlike the foregoing method according to the attached claim 9. Masking with a plating resist is provided on the scissors blade except the slits, e.g. by printing means. The side walls of the slits are thus exposed, which are activated and electroplated as taught in relation to the attached claim 9. A bonding film is provided on the side walls of the slits.

The scissors blade with the slits is immersion plated in an immersion plating bath of a metallic material which has a lower melting point than the material of the scissors blade. The fused immersion material forms fillers on the bonding film in the slits.

This method provides an advantageous feature over the method of the attached claim 9. According to the method of the claim 9, slits are provided on the cutting edge of a scissors blade after a masking process. Slits of the present invention may advantageously be provided with a rotary disk grinder. When the masking material is a paint type, the paint may stick onto the disk grinder to the detriment of the function of the disk grinder. When the masking material and the disk grinder are not congenial with each other, the disk grinder may not provide efficient and precision cutting, or may be broken or damaged otherwise. The method according to the attached claim 10 solves such problems.

The masking material may accidentally enter the slits, which hinders steady formation of a bonding film and thus hinders formation of fillers in the slits. In order to prevent the masking material from accidentally entering the slits, the attached claim 11 provides another alternative method.

This method applies on a scissors blade made of a ferrous material. First, slits are provided on the haircut edge of the scissors blade. The scissors blade is wholly activated or selectively and partially activated including at least the slit portions as previously described. The scissors blade is then electroplated without masking so that a bonding film is formed on the activated surfaces of the scissors blade including the slits.

Next, the slits are masked with a plating resist, and the other portions of the scissors blade are made nonconductive by applying thereon, e.g. lithium silicate (water glass), nitric acid, electroplating paint or chromium oxide so that the nonconductive surfaces shed a molten immersion plating material during a subsequent immersion plating process. After this non-conductivity treatment, the masked material of the slits is removed and a metallic material having a lower melting point than the metallic material of the scissors blade is immersion plated so that fillers are formed on the bonding film in the slits.

The electroplating for forming a bonding film in the slits may be performed using an Ni material or Fe material, then using an Au material, as defined in the attached claim 12. The fillers provided on the bonding film in the slits are stable.

The thickness of the Ni or Fe film is preferred to be between 0.5 $\mu$m–1.5 $\mu$m. If the thickness of the bonding film is below 0.5 $\mu$m, the filler formed thereon will not be stable, and if the thickness exceeds 1.5 $\mu$m, the bonding film will be undulated and microscopic voids will be generated in the bonding film. As for the Au film, the thickness is preferred to be between 0.05 $\mu$m–0.2 $\mu$m.

The method defined in the attached claim 13 uses metallic powder to form cores of the fillers in the slits. A metallic material having nearly the same melting point as the powder is used to immersion plate the scissors blade whose slits are packed with the metallic powder. Formation of microscopic voids or bubbles in the fillers can be effectively avoided.

An appropriate metallic powder material may be soaked in a flux, which facilitates easy packing of the powder in the slits. A preferred average particle size of the metallic powder is 20 $\mu$m. Other sizes may be equally utilized.

BEST MODE FOR CARRYING OUT THE INVENTION

The present invention is further described using several embodiments and the accompanying drawings.

Embodiment 1

Figure 1:
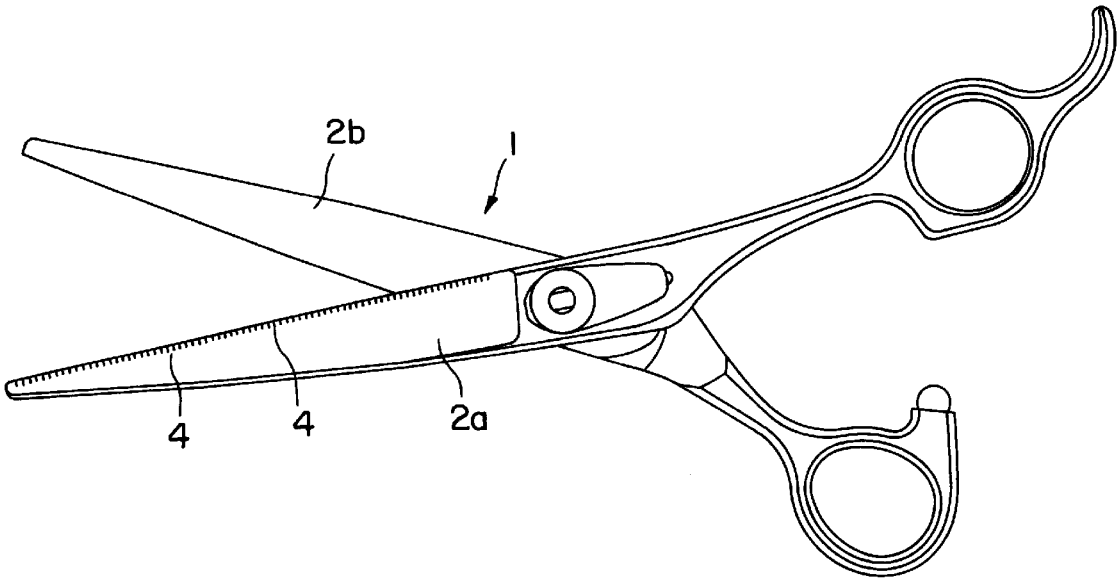
FIG. 1 shows a pair of haircut scissors having slits with fillers and nicks on one of the scissors blades according to an embodiment of the present invention.
Figure 2:
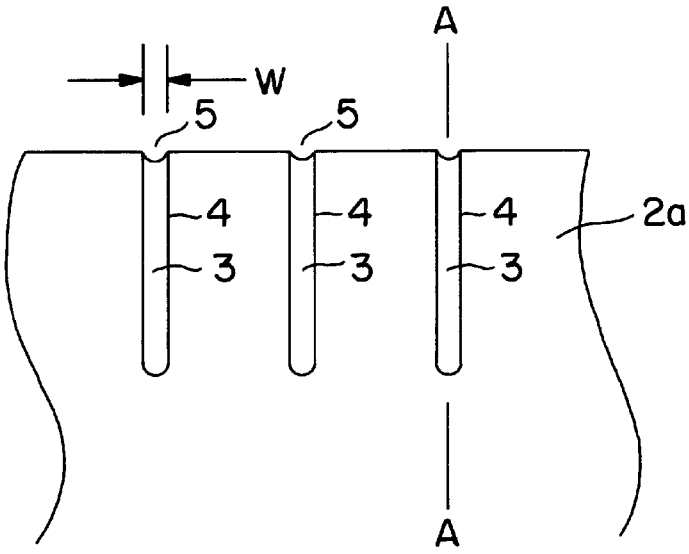
FIG. 2 is an enlarged partial view of the haircut edge of the scissors blade having slits with fillers and nicks according to an embodiment of the present invention.

FIG. 1 shows a pair of haircut scissors 1 comprising a pair of scissors blades 2*a* and 2*b*. The scissors blade 2*a* is provided with numerous slits 4 where fillers 3 are provided as clearly shown in FIG. 2. In this embodiment, the diameter of hairs is assumed to be 0.08 mm and the width W of each slit 4 is 0.10 mm. The length of the slit 4 is about 1.0 mm. The slits 4 are provided along the haircut edge of the scissors blade 2*a* at about 1.0 mm intervals.

Figure 3:
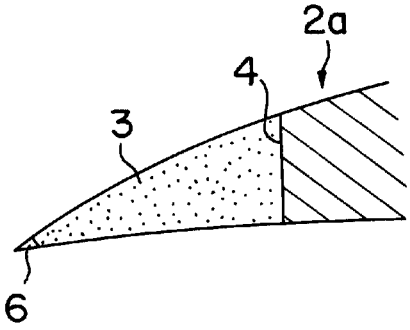
FIG. 3 is a sectional view taken along A—A line of FIG. 2, showing a section of the filler and the nick.
Figure 4:
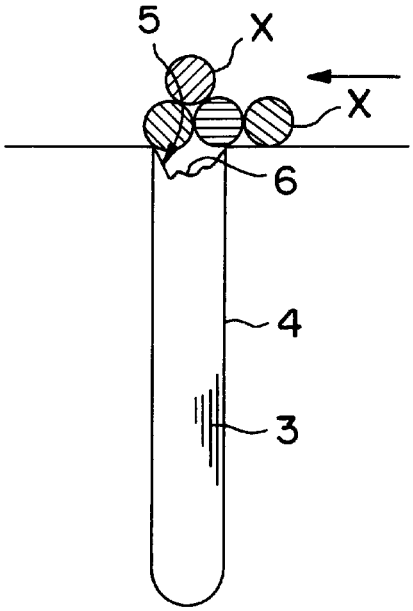
FIG. 4 is a schematic view showing how hairs are caught in the nick of the filler in the slit.
Figure 5:
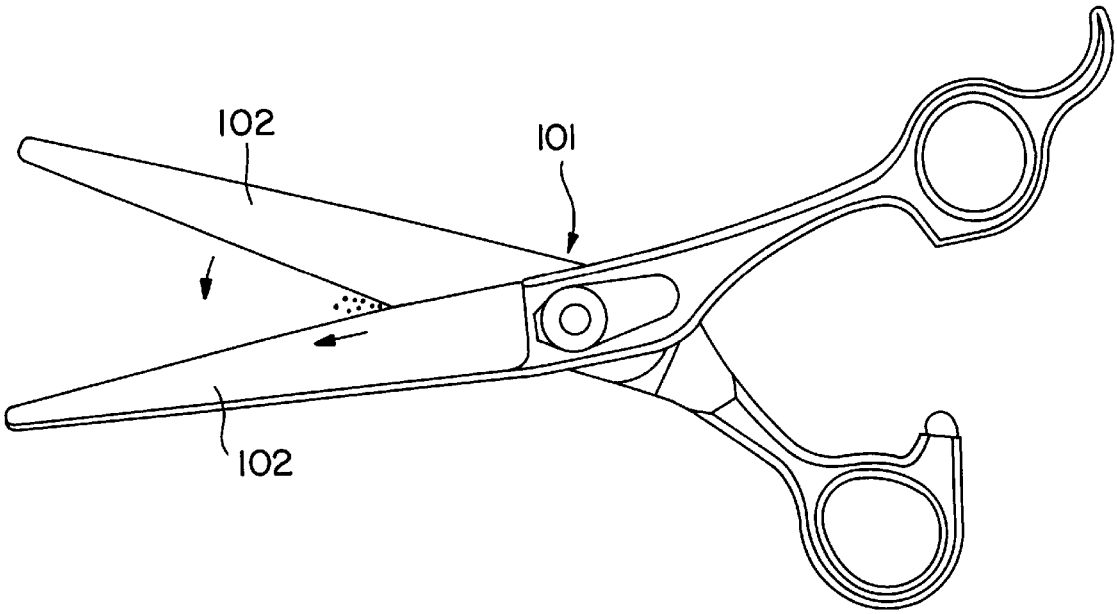
FIG. 5 PRIOR ART
FIG. 5 shows a conventional pair of haircut scissors comprising two scissors blades, showing how hairs pinched between the scissors blades escape along the haircut edges of the scissors blades.
Figure 6:
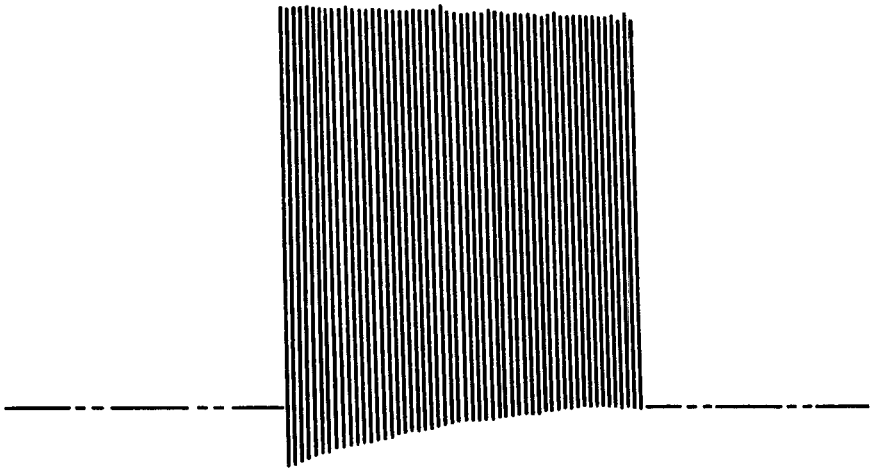
FIG. 6 PRIOR ART
FIG. 6 shows how combed hairs are cut with a conventional pair of scissors.
Figure 7:
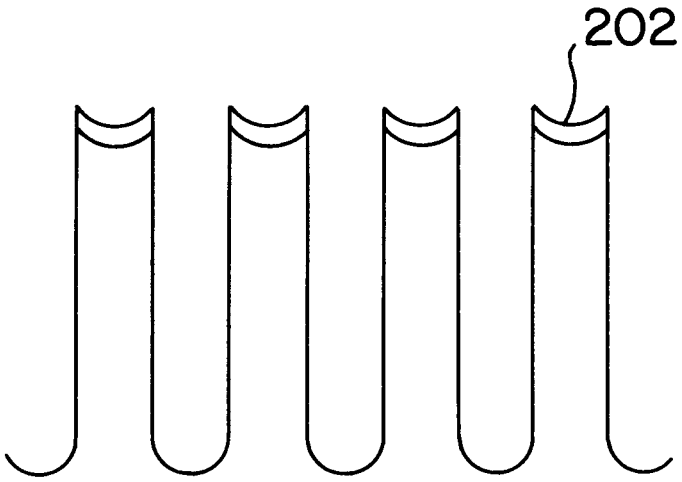
FIG. 7 PRIOR ART
FIG. 7 partially shows haircut edges of a conventional pair of thinning scissors.
Figure 8:
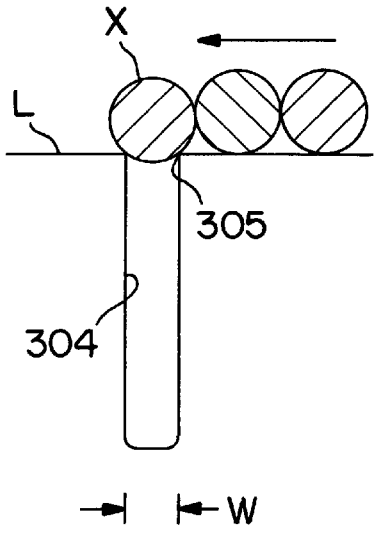
FIG. 8 PRIOR ART
FIG. 8 schematically shows how hairs are caught by a slit of a scissors blade of a prior art pair of scissors according to an embodiment of International Application No. PCT/JP99/05381, the diameter of the slit being smaller than that of the hairs.
Figure 9:
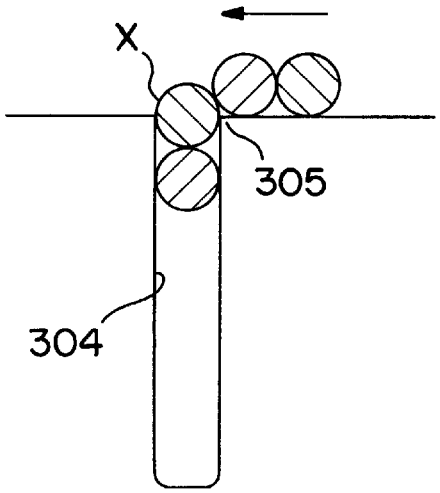
FIG. 9 PRIOR ART
FIG. 9 schematically shows how hairs are caught by a slit of a scissors blade of a prior art pair of scissors according to another embodiment of International Application No. PCT/JP99/05381, the diameter of the slit being as large as that of the hairs.
Figure 10:
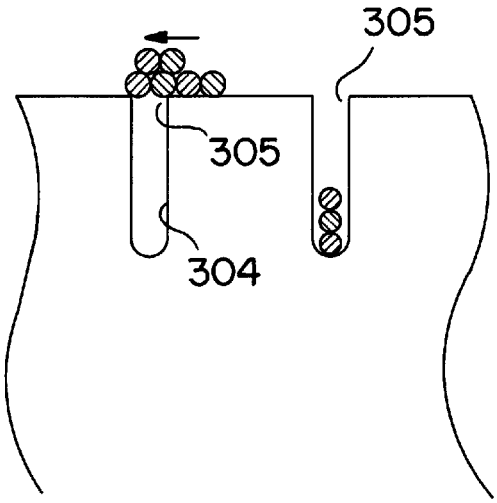
FIG. 10 PRIOR ART
FIG. 10 schematically shows how hairs are caught by slits of a scissors blade of a prior art pair of scissors according to another embodiment of International Application No. PCT/JP99/06381, the diameter of the slit being nearly twice as large as that of the hairs, where a group of hairs are shown caught by one slit and another group of hairs are shown fallen in another slit.

Each slit 4 is packed with a filler material so as to provide a filler 3, which has a melting point lower than that of the scissors blade 2*a*. As shown in FIGS. 3 and 4, a top portion of each filler 3 adjacent to the mouth 5 of the slit is cut off to provide a microscopic nick 6. The nick 6 though microscopic in size will catch and hold hairs X from further sliding on the haircut edge. The slit 4 shown in FIG. 4 is thicker than hairs X. However, the open mouth 5 of the slit and the nick 6 will firmly hold hairs X together in a group motionless on the slit 4. The filler 3 prevents hairs X from entering the slit 4.

Pairs of haircut scissors need be whetted once in a while so that their sharpness is retained. The nicks 6 of the present invention will be renewed by such whetting processes and "fresh" nicks 6 are generated incessantly by whetting.

Embodiment 2

A pair of haircut scissors including a scissors blade with slits having fillers of the present invention as disclosed in Embodiment 1 are produced as follows.

A roughly produced scissors blade 2*a* is finely ground or whetted on both sides, which is masked with a plating resist on both sides. A plurality of slits 4 each having a width W are provided along the haircut edge of the scissors blade 2*a* at predetermined intervals. Those slits 4 are typically provided by shallowly cutting in the haircut edge of the scissors blade 2*a* at a normal angle at predetermined intervals with a rotary disk grinder having a corresponding thickness (not shown).

The scissors blade 2*a* with the slits 4 is then electroplated, e.g. with Au. The "narrow" slits 4 will be adequately filled up with the plating material. If not adequately filled up with the plating material in a single plating process, the process is repeated or the process time is extended. The plating material is electroplated on the scissors blade 2*a* other than the slits 4 thanks to the masking. The scissors blade 2*a* so prepared is then removed of the masking material. It is possible to mask the scissors blade 2*a* prior to its grinding process, in which case the grinding is performed after providing slits 4 and electroplating the masked scissors blade 2*a*.

It is also possible to eliminate the masking process, where the whole scissors blade 2*a* having slits 4 is electroplated and the plated material is selectively removed from the scissors blade 2*a*, though it is to be understood that the masking will contribute to steady formation of fillers 3 in the slits 4.

Embodiment 3

A scissors blade 2*a* is masked all over and slits 4 are provided on the masked scissors blade 2*a*. The slits 4 are filled up tight with Au/In/Sn alloy powder which possesses a lower melting point than the scissors blade material. The scissors blade 2*a* is heated to 250–300° C. and immersed in an Au/In/Sn alloy material heated to 250–300° C. in a plating bath for immersion plating. The Au/In/Sn powder packed in the slits 4 is fused in the plating bath. The scissors blade 2*a* is drawn up from the Au/In/Sn bath and left to harden within the slits 4 to form fillers 3.

The alloy powder considerably shrinks when fused partly because the microscopic voids in the powder disappear, and the surfaces of the fillers will microscopically retreat from the surfaces of the scissors blade 2*a*. The electroplating will more than compensate the shrinkage of the alloy powder.

Other metallic materials such as Au/Sn, Au/In, Au/Si, Ag/Ge, Ag/Sn and Ag/In alloys may be alternatively utilized according to the colors, hardness and/or melting temperatures desired. The metallic material for immersion plating may be different from the powder material. For an alloy powder material Au/Sn, Au/In, Au/Si, Ag/Ge, Ag/Sn, Ag/In, orAu/In/Sn, an immersion plating material of solder (e.g. 96.5(Sn):3.5(Ag)) may be used.

The scissors blade 2*a* is ground or whetted on both sides so that the plated material is removed from the surfaces of the scissors blade 2*a*. The surfaces of the plated material in the slits 4 forming fillers 3 of the present invention are ground and become coplanar with the surfaces of the scissors blade 2*a*. Concurrently, nicks 6 are formed on the fillers 3 as described earlier.

Embodiment 4

In this embodiment, the fillers 3 are formed as follows.

The slits 4 are cleaned by alkaline degreasing and electrolytic degreasing means. Then the scissors blade 2*a* is immersed in a 10% phosphoric acid solution for anodic electrolysis and in a hydrochloric acid solution for activation. Next the scissors blade 2*a* is Ni plated in an Ni strike plating bath and Au plated in an Au strike plating bath.

After thoroughly washed and dried, the slits 4 are impregnated with a rosin flux. The scissors blade 2*a* is then immersed in a fused Sn/Ag alloy bath. Au may be dispersed in the Sn/Ag alloy, however, as the activity of the Ni surface is preserved, the fillers 3 formed in the slits 4 are firm and will not be adversely affected by subsequent machine grinding of the scissors blade 2*a*.

Embodiment 5

In this embodiment, the Ni plating is replaced with Fe plating (1 $\mu$m thick) to be plate with Au (0.1 $\mu$m thick) by Au striking plating. Although Au may be dispersed in the Sn/Ag alloy, as activity of the Fe surface is preserved, the fillers 3 formed in the slits 4 are firm and will not be adversely affected by subsequent machine grinding of the scissors blade 2*a*. Allergy by Ni is thus prevented.

Embodiment 6

In this embodiment, the fillers 3 are formed as follows. A scissors blade 2*a* is masked and provided with slits 4. At least the slits 4 are activated. The activated slits 4 are then plated with Ni and Au. After washing and drying, the slits 4 are masked with a plating resist and the other portions of the scissors blade 2*a* are removed of the plated material in a nitric acid solution.

The portions of the scissors blade 2*a* not masked are then made nonconductive. The scissors blade 3*a* is immersed in a 200 ml/l water solution of lithium silicate and then dried. A lithium glass film (nonconductive film) is thus formed. Of the scissors blade 2*a*, a haircut edge portion having the slits 4 is now plated with a plating resist and an opposite back portion is now made nonconductive.

The plated resist of the slits 4 is then removed. The slits 4 are washed and dried. Sn/Ag powder (20 $\mu$m in diameter) impregnated with a rosin flux is packed in the slits 4. The scissors blade 2*a* is immersed in a fused Sn/Ag alloy bath. Stable fillers 3 without porosity are thus formed in the slits 4. These fillers 3 will not be adversely affected by subsequent machine grinding of the scissors blade 2*a*.

Embodiment 7

In this embodiment, the Ni plating is replaced with Fe plating. The Fe plating is performed after activation of the slits 4 in an Fe strike plating bath containing iron chloride (300 ml/1), calcium chloride (300 ml/l), hydrochloric acid (50 ml/l) and hydrazine chloride (10 g/l), and then Au strike plating is performed. In this way, oxidation of the Fe plating bath will be prevented. The fillers 3 formed in the slits 4 are stable and will not be adversely affected by subsequent machine grinding of the scissors blade 2*a*.

Although this invention has been described using several embodiments, the present invention should not be limited to those embodiments. Various modifications and changes of those embodiments will occur to persons skilled in the art within the scope of the attached claims.

For example, the metallic powder to be packed in the slits may be directly heated and hardened without subsequent plating. Various fusing processes including utilization of ultrasonic means or electric iron may be employed. Other materials for the fillers which provide the expected effects of the present invention can be equally utilized.

When plastic materials or rubbers are to be used, such materials heated to their respective melting temperatures may be applied in the slits by screw injection means and surface treated so as to make the surfaces of the fillers coplanar with the surfaces of the scissors blade.

The slits may be provided on the scissors blade in other arrangements including providing the slits partially along the haircut edge of the scissors blade. Both scissors blades of a pair of haircut scissors may be provided with the slits of the present invention.

It is to be noted that the haircut scissors of the present invention include scissors of types other than those shown in the accompanying drawings. It is also to be noted that every slit of the present invention need not have a filler, or every filler need not possess a nick.

What is claimed is:

1. A haircut scissors instrument comprising a pair of scissors blades, each having a cutting edge, at least one of said scissors blades having a plurality of slits provided along its cutting edge in an arrangement, wherein each said slit is less than twice as wide as a hair to be cut and essentially each of said slits is provided with a filler, said filler being provided with a nick at the top edge thereof, defining part of the cutting edge.

2. A haircut scissors instrument according to claim 1, wherein a portion of the filler at the cutting edge is thinnest and said nick is formed through whetting of said scissors blades.

3. A pair of haircut scissors according to claim 1, wherein said nick is formed by the pressure from a hair or hairs while said haircut scissors are in use.

4. A pair of haircut scissors according to claim 1, wherein said filler is formed by plating.

5. A pair of haircut scissors according to claim 1, wherein said filler is formed of a metallic powder material and a metallic plating material, said metallic powder material having a melting point which is lower than the melting point of said scissors blades and said metallic plating material having a melting point which is practically the same as the melting point of said powder material, wherein said metallic powder material is packed in said slits and is immersion plated with said metallic plating material.

6. A method for producing a pair of haircut scissors instrument comprising a pair of scissors blades each having a cutting edge, at least one of said scissors blades having a plurality of slits provided along its cutting edge in an arrangement, wherein at least some of said slits are less than twice as wide as a typical hair, said method including the step of providing essentially each of said slits with a filler and the step of providing essentially each of said slits with a nick at the top edge thereof.

7. A method according to claim 6, wherein said filler providing step is carried out by electroplating to essentially fill the slit.

8. A method according to claim 6, wherein said filler providing step is performed by immersion plating with a metallicmaterial whose melting point is lower than the melting point of said scissors blades.

9. A method according to claim 6, as applied on scissors blades made of a ferrous material, further including the step of masking said scissors blade having said slits with a plating resist, the step of activating said slits, and the step of electroplating said slits to provide a bonding film in each slit, wherein said filler providing step is performed by immersion plating with a metallic material whose melting point is lower than the melting point of said scissors blades, said filler being formed on said bonding film.

10. A method according to claim 6, as applied on scissors blades made of a ferrous material, further including the step of providing a plurality of slits on at least one of said scissors blades, the step of masking the scissors blade having said slits with a plating resist except in said slits, the step of activating said slits, and the step of electroplating said slits to provide a bonding film in each slit, wherein said filler providing step is performed by immersion plating with a metallic material whose melting point is lower than the melting point of said scissors blades, said filler being formed on said bonding film.

11. A method according to claim 6, as applied on scissors blades made of a ferrous material, further including the step of providing a plurality of slits on at least one of said scissors blades, the step of activating at least said slits, the step of electroplating the scissors blade having said slits to provide a bonding film in each slit, the step of masking said slits to provide a masking film in each slit, and the step of making said scissors blade nonconductive where no masking is performed, wherein said filler providing step is performed by immersion plating with a metallic material whose melting point is lower than the melting point of said scissors blades after having removed said masking film, said filler being formed on said bonding film.

12. A method according to any one of claims 9 to 11, wherein said bonding film is formed through Ni plating in an Ni plating bath or Fe plating in an Fe plating bath, and Au plating in an Au plating bath.

13. A method according to any one of claims 9 to 11, wherein said immersion plating is performed after said fillers have been formed in said slits with a metallic powder material whose melting point is practically the same as the melting point of said immersion plating metallic material.

* * * * *